US006920870B2

(12) United States Patent
Minica et al.

(10) Patent No.: US 6,920,870 B2
(45) Date of Patent: Jul. 26, 2005

(54) ARROW SUPPORT BY MAGNETIC LEVITATION

(75) Inventors: Stuart Minica, 414 Hidden Deer, LaVernia, TX (US) 78121; Christian Welch, Montrose, CO (US); John Michael Rozmus, Cedar Park, TX (US)

(73) Assignee: Stuart Minica, Lavernia, TX (US)

( * ) Notice: Subject to any disclaimer, the term of this patent is extended or adjusted under 35 U.S.C. 154(b) by 0 days.

(21) Appl. No.: 10/732,120

(22) Filed: Dec. 10, 2003

(65) Prior Publication Data

US 2005/0126554 A1 Jun. 16, 2005

(51) Int. Cl.[7] ..... F41B 5/22; F42B 6/04
(52) U.S. Cl. ..... 124/44.5; 473/578
(58) Field of Search ..... 124/24.1, 44.5; 473/578, 582, 583

(56) References Cited

U.S. PATENT DOCUMENTS

| | | | | |
|---|---|---|---|---|
| 4,676,220 | A * | 6/1987 | Pietraszek | 124/44.5 |
| 5,456,242 | A * | 10/1995 | Ruholl | 124/44.5 |
| 5,503,136 | A * | 4/1996 | Tone | 124/44.5 |
| 5,673,678 | A | 10/1997 | Savage | |
| 5,896,849 | A | 4/1999 | Branthwaite | |
| 6,082,348 | A | 7/2000 | Savage | |
| 6,558,280 | B1 * | 5/2003 | Kuhn | 473/578 |
| 6,561,174 | B1 | 5/2003 | Afshari | |
| 6,688,296 | B1 * | 2/2004 | Greywall | 124/44.5 |
| 6,688,297 | B1 * | 2/2004 | Clague | 124/44.5 |

* cited by examiner

*Primary Examiner*—John A. Ricci
(74) *Attorney, Agent, or Firm*—John Michael Rozmus

(57) ABSTRACT

An archer may levitate the front of an arrow in a magnetic field rather than resting the arrow against a mechanical arrow rest attached to a bow. From the first moment of release, the arrow has no contact with the bow or any apparatus attached to the bow.

36 Claims, 14 Drawing Sheets

ARROW SUPPORT BY MAGNETIC LEVITATION

BACKGROUND

1. Field of the Invention

The present invention relates to the field of archery, specifically to the problem of releasing an arrow with the least possible interference to its intended flight path.

2. Prior Art

At the moment just before an archer releases an arrow from a bow, the rear end of the shaft of the arrow is supported in a stable position against the bowstring, and the front end of the arrow is supported in a stable position with relation to the bow. An arrow is in a stable position with relation to a bow when any slight displacement of the arrow from that position results in a force pushing the arrow back to that position. The front end support, often called an arrow rest, may be as simple as a notch cut in the riser, or handle, near the middle of a bow. It is evident that friction between an arrow shaft and an arrow rest, or contact between an arrow's fletches (stabilizing vanes or feathers) and a bow or an arrow rest, may cause the arrow to deviate from its intended path after it is released.

Many devices have been made to minimize such deviations. One class of such devices uses arrow rests formed from very light, flexible material that bends out of the way as the arrow passes. (See, for example, U.S. Pat. No. 5,896,849, "Arrow Rest", to Branthwaite et al.) Another class of such devices uses very low friction coatings, such as Teflon, on arrow rests to minimize friction against the shaft of the arrow as it passes. (See, for example, U.S. Pat. No. 5,673,678, "Arrow Rest for Archery Bow", to Savage.) A third class of such devices supports an arrow on high-friction prongs, which are held in position by a delicate balance of mechanical spring and magnetic forces. Immediately after release, the shaft of the arrow causes a slight drag on the high-friction prongs, which causes the balance of mechanical and magnetic forces to swing the prongs out of the way of the arrow for the remainder of its flight. (See, for example, U.S. Pat. No. 6,561,174, "Arrow Rest", Afshari, and U.S. Pat. No. 6,082,348, "Arrow West" [sic], to Savage.) A fourth class of devices uses a magnet to hold the front of an arrow containing ferromagnetic material in direct contact with the magnet. (See U.S. Pat. No. 4,343,286, "Archery Bow", to Thacker.) All of the arrow rests in the prior art require some direct contact between a bow, or an apparatus affixed to the bow, and an arrow during the arrow's flight.

Objects and Advantages

The present invention eliminates all contact between an arrow and a bow, or an apparatus affixed to the bow, from the first moment of release. Thus friction or contact with the bow, or an apparatus affixed to the bow, causes no deviation of the arrow from its intended flight path.

SUMMARY

A magnetic field supports a magnetic arrow in a stable position with relation to a bow just before the arrow is released from the bow. From the first moment of release, there is no contact between the arrow and the bow, or any apparatus affixed to the bow.

DETAILED DESCRIPTION

Preferred Embodiments: Structure and Operation

Figure 1:
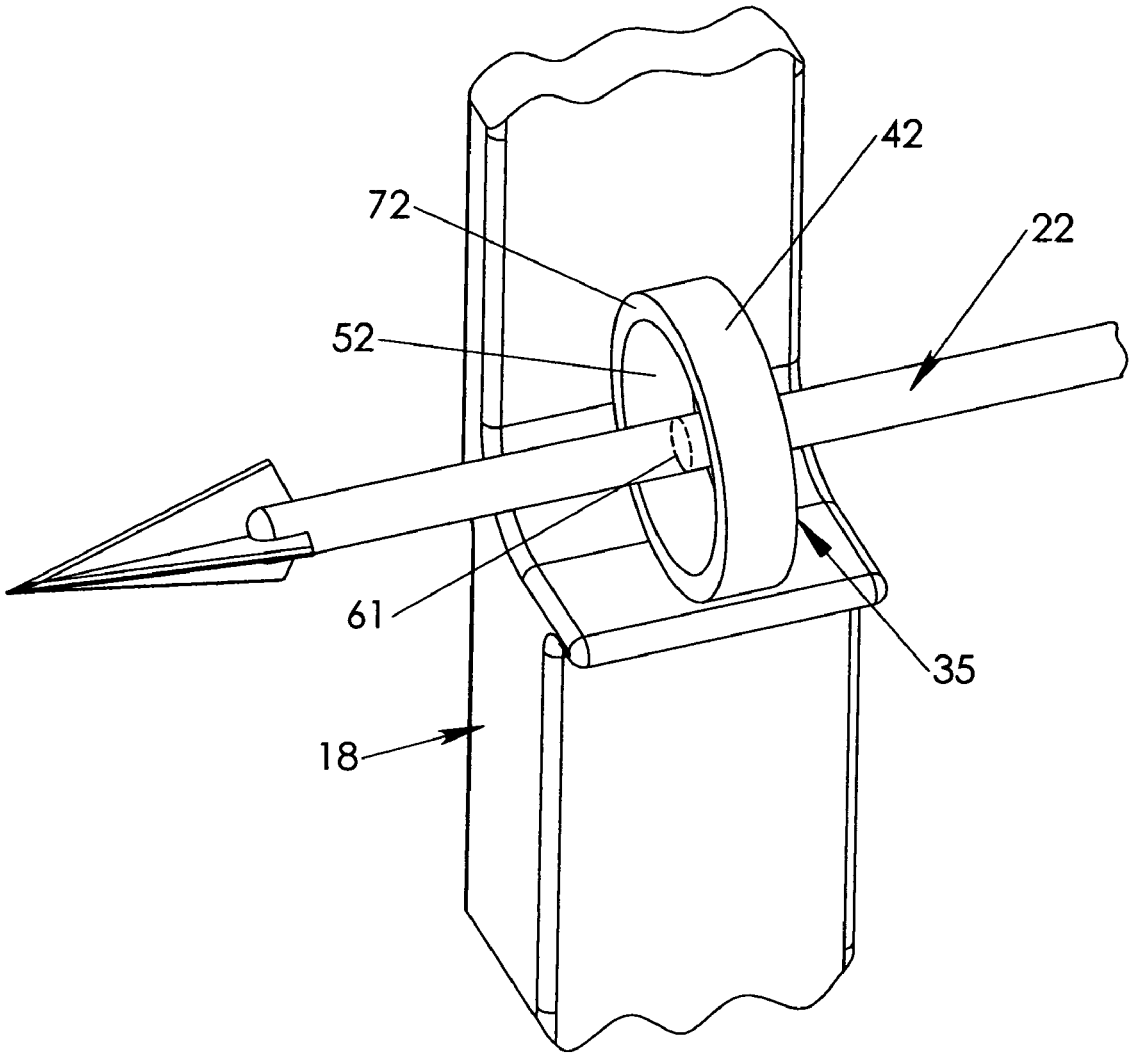
FIG. 1 is a perspective view of a radially magnetized magnetic arrow in release position at a bow levitated by a magnetic field from a ring magnet.
Figure 2:
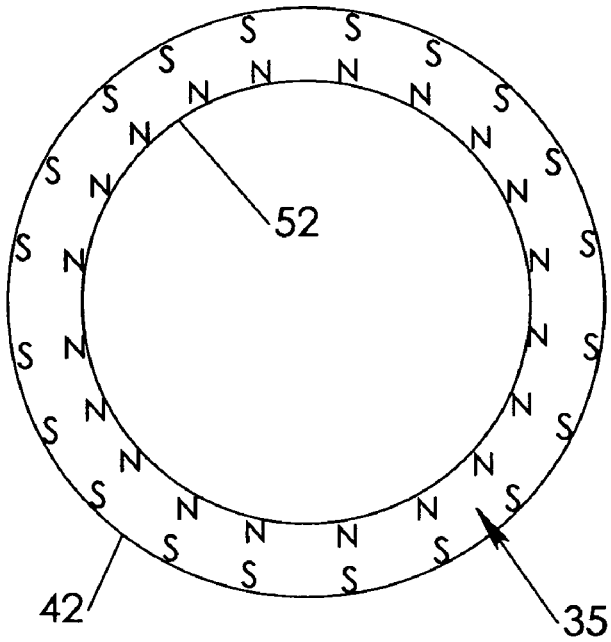
FIG. 2 shows a ring magnet with a radially oriented magnetic field.

In FIG. 1, a permanent ring magnet 35 is firmly affixed to a bow 18 somewhere near the middle section of bow 18 where an archer would normally grab bow 18. The ring magnet has a front face 72, an inner cylindrical surface 52, an outer cylindrical surface 42, and a rear face that is not visible in the drawing. The magnetism of ring magnet 35 is oriented radially, as shown in a front view of ring magnet 35 in FIG. 2. Inner cylindrical surface 52 is the north pole and outer cylindrical surface 42 is the south pole. Ring magnet 35 may be formed from a single piece of permanently magnetic material or it may be composed of a number of separate pieces, each of which is mounted with its magnetic field radially aligned.

Figure 4:
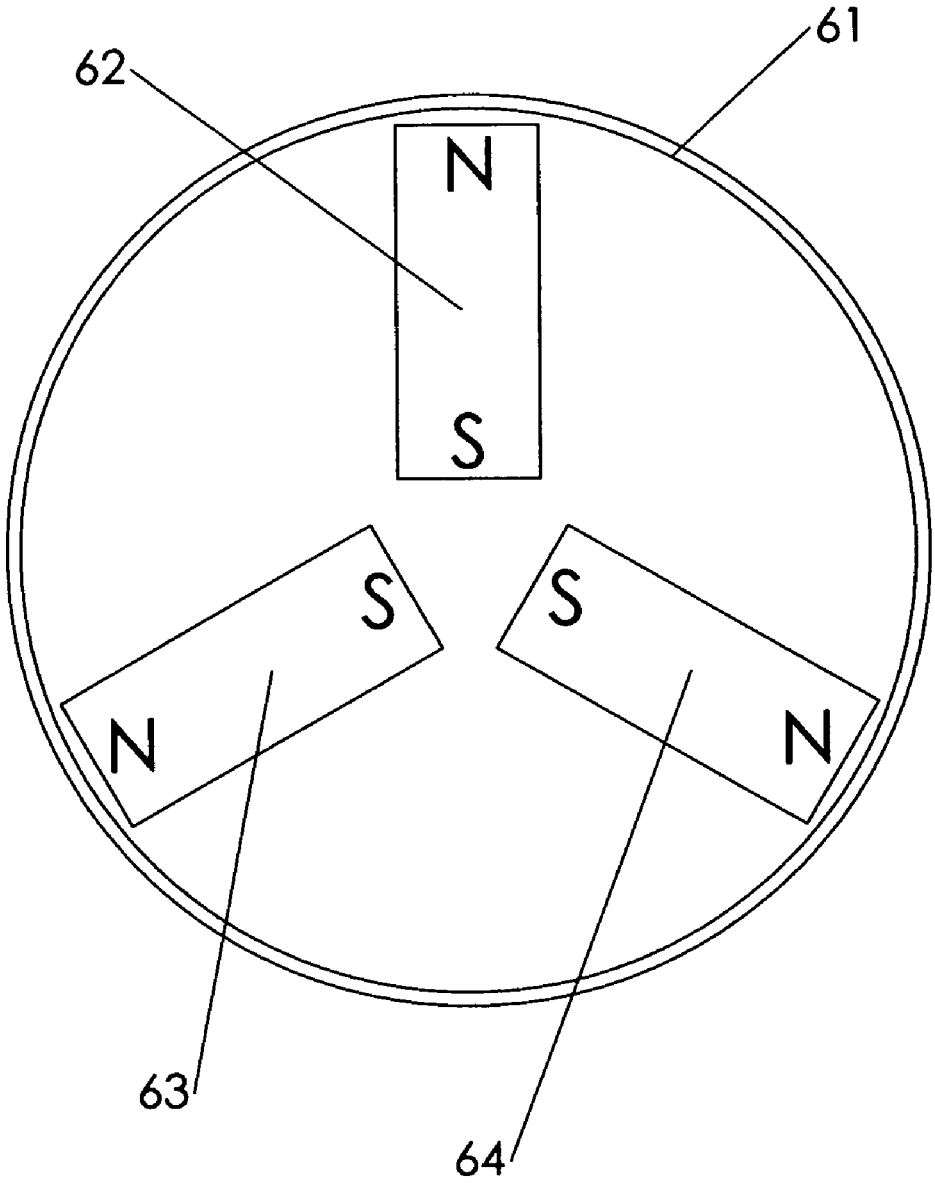
FIG. 4 shows three magnets embedded in a cross section of the shaft of a magnetic arrow.

A magnetic arrow 22 in FIG. 1 is poised in position just before release from bow 18. Magnetic arrow 22 has much the same properties as a typical non-magnetic arrow except there are three magnets 62, 63, and 64, embedded in a perpendicular cross section 61 of the shaft of arrow 22, as shown in FIG. 4. Magnets 62, 63, and 64 are arranged radially, perpendicular to the axis of the shaft, with north poles facing outward and south poles facing inward.

To get arrow 22 into the stable release position shown in FIG. 1, an archer slides arrow 22, rear first from the front, through the hole in ring magnet 35. The archer then places the rear end of the arrow against the bowstring and draws the bow into release position. The length of arrow 22 and the position of the bowstring at full draw are designed together to place cross section 61 near the center of ring magnet 35 at full draw just before release. The hole through ring magnet 35 is large enough to provide sufficient clearance for magnetic arrow 22 to pass through after being released without any part of arrow 22 touching ring magnet 35.

The front end of magnetic arrow 22 is shown in FIG. 1 levitating in the hole of ring magnet 35. This occurs because magnets 62, 63, and 64 are each repelled by ring magnet 35. Because of the shape of ring magnet 35, the repulsive magnetic forces on arrow 22 are substantially radially inward. If cross section 61 is not in the exact center of ring magnet 35, the repulsive magnetic forces may also be slightly forward (for forward of center positioning) or slightly rearward (for rearward of center positioning). Since the rear end of arrow 22 is held firmly against the drawn bowstring, the forward or rearward magnetic forces are counterbalanced. The radially inward magnetic forces center arrow 22 into a good, stable position for release. Gravity is counterbalanced by the repelling force from the lower part of ring magnet 35. Thus ring magnet 35 affixed to bow 18 forms a magnetic support assembly. By providing bow 18, providing magnetic arrow 22, and arranging magnetic fields from this magnetic support assembly, arrow 22 is levitated in a stable position with respect to bow 18.

Figure 3:
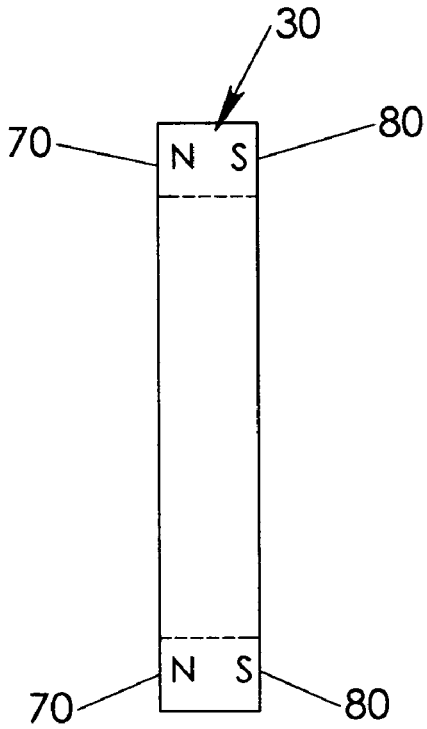
FIG. 3 shows an edge, or side, view of a typical ring magnet with an axially oriented magnetic field.
Figure 5:
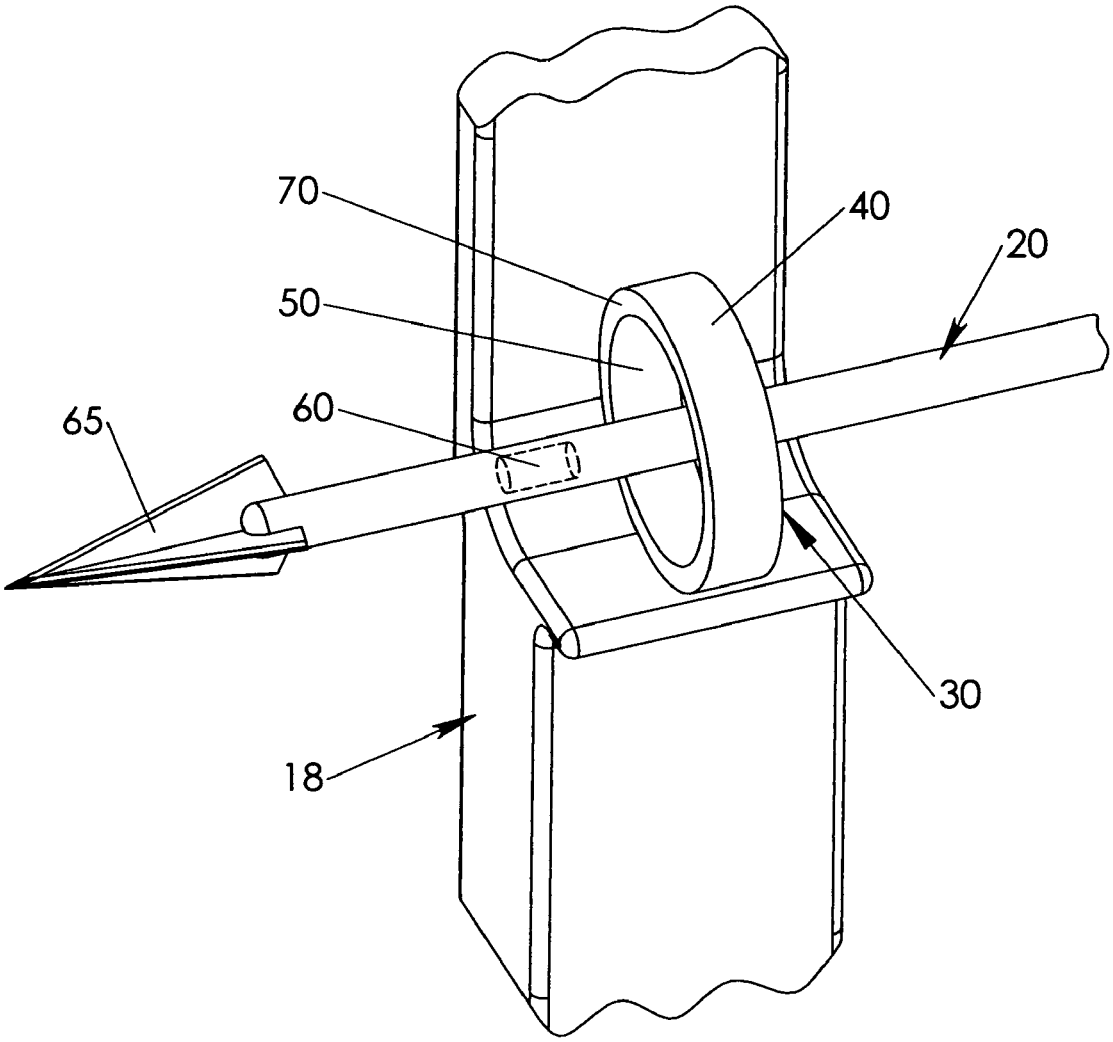
FIG. 5 is a perspective view of an axially magnetized magnetic arrow in release position at a bow levitated by a magnetic field from a ring magnet. The magnet in the magnetic arrow is set forward of the ring magnet.

In FIG. 5, a permanent ring magnet 30 is firmly affixed to a bow 18 somewhere near the middle section of bow 18 where an archer would normally grab bow 18. The ring magnet has a front face 70, an inner cylindrical surface 50, an outer cylindrical surface 40, and a rear face 80 (shown in FIG. 3). The magnetism of ring magnet 30 is axially oriented, as shown in an edge, or side, view of ring magnet 30 in FIG. 3. Front face 70 is the north pole and rear face 80 is the south pole.

A magnetic arrow 20 in FIG. 5 is poised in position just before release from bow 18. Magnetic arrow 20 has much the same properties as a non-magnetic arrow except there is a small permanent magnet 60 in the shaft of arrow 20 on the centerline near the forward end behind an arrowhead 65. Permanent magnet 60 is axially oriented with its north pole rearward and its south pole forward.

To get arrow 20 into the stable release position shown in FIG. 5, an archer slides arrow 20, rear first from the front, through the hole in ring magnet 30. The archer then places the rear end of the arrow against the bowstring and draws the bow into release position. The length of arrow 20 and the position of the bowstring at full draw are designed together to place small magnet 60 just forward of ring magnet 30 at full draw just before release. The hole through ring magnet 30 is large enough to provide sufficient clearance for magnetic arrow 20 to pass through after being released without any part of arrow 20 touching ring magnet 30.

The front end of magnetic arrow 20 is shown in FIG. 5 levitating in the hole of ring magnet 30. This occurs because magnet 60 and ring magnet 30 repel each other. Because of the shape of ring magnet 30, the repulsive magnetic forces on arrow 20 are radially inward as well as forward. Since the rear end of arrow 20 is held firmly against the drawn bowstring, the forward magnetic force is counterbalanced. The radially inward magnetic forces center arrow 20 into a good, stable position for release. Gravity is counterbalanced by the repelling force from the lower part of ring magnet 30. Thus ring magnet 30 affixed to bow 18 forms a magnetic support assembly, which levitates arrow 20.

Figure 6:
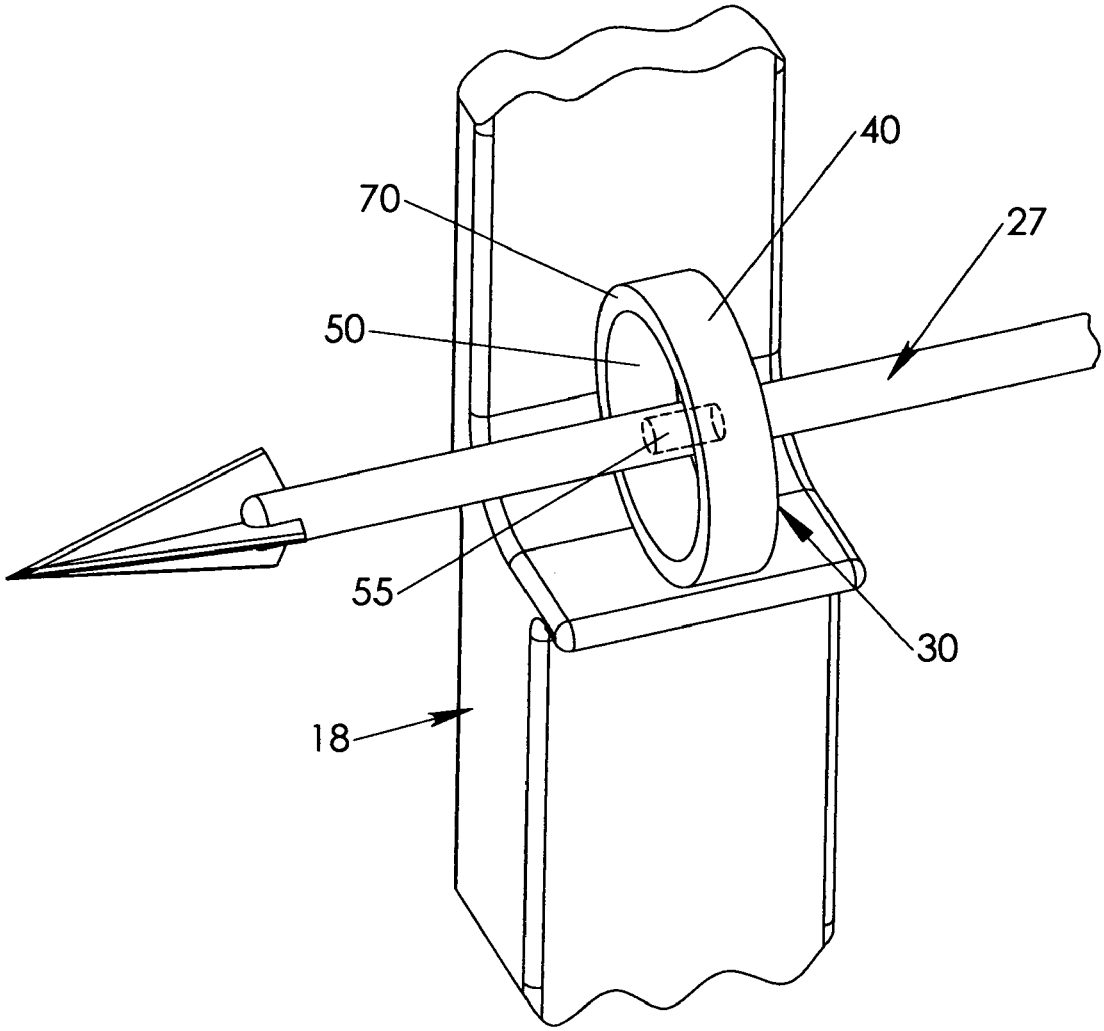
FIG. 6 is a perspective view of an axially magnetized magnetic arrow in release position at a bow levitated by a magnetic field from a ring magnet. The magnet in the magnetic arrow is set at the center of the ring magnet.

Other arrangements of magnetic fields may be chosen to successfully levitate the front of an arrow. FIG. 6 is very similar to FIG. 5 except that magnet 55 substitutes for magnet 60 of FIG. 5. Magnet 55 has polarity opposite to magnet 60. Magnet 55 is positioned further toward the rear in the shaft of the arrow 27 so that magnet 55 is centered in the hole of ring magnet 30 when the bow is fully drawn just before release. In this arrangement, the forward-facing north pole of magnet 55 is repelled backward and radially inward by the north pole of front face 70 of ring magnet 30. The rearward-facing south pole of magnet 55 is repelled forward and radially inward by the south pole of rear face 80 of ring magnet 30. The inward forces center arrow 27 in ring magnet 30. Gravity is counterbalanced by the upward repelling force from the lower portion of ring magnet 30.

Figure 7:
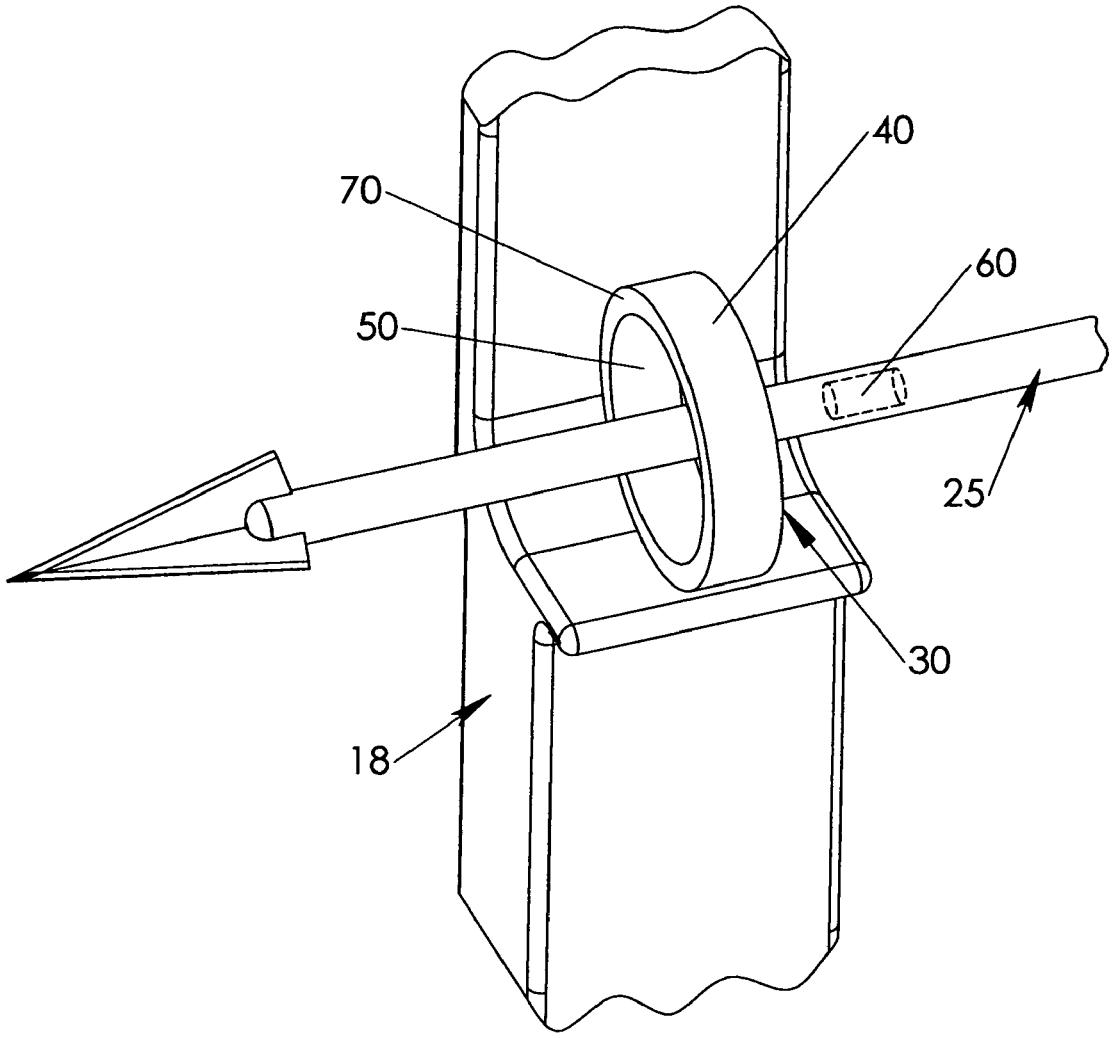
FIG. 7 is a perspective view of an axially magnetized magnetic arrow in release position at a bow levitated by a magnetic field from a ring magnet. The magnet in the magnetic arrow is set behind the ring magnet.

FIG. 7 is very similar to FIG. 5, except that magnet 60 is positioned further toward the rear in the shaft of arrow 25 so that magnet 60 is just to the rear of ring magnet 30 when the bow is fully drawn just before release. In this arrangement, the forward-facing south pole of magnet 60 is repelled backward and radially inward by the south pole of rear face 80 of ring magnet 30. The backward force is counterbalanced by the bowstring against the rear end of arrow 25. The inward forces center arrow 25 in ring magnet 30. Gravity is counterbalanced by the upward repelling force from the lower portion of ring magnet 30.

Figure 8:
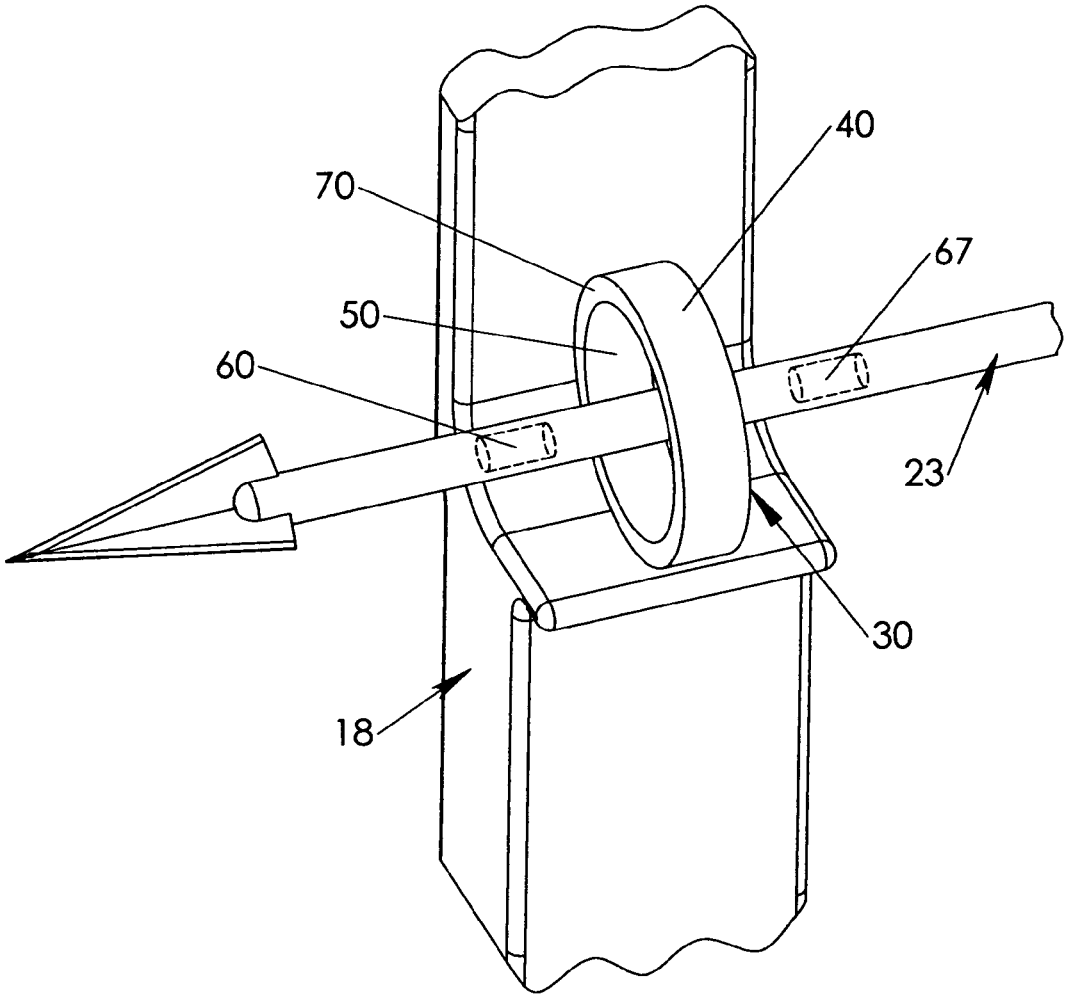
FIG. 8 is a perspective view of an axially magnetized magnetic arrow in release position at a bow levitated by a magnetic field from a ring magnet. The two magnets in the magnetic arrow are set one behind and one forward of the ring magnet.

FIG. 8 is very similar to FIG. 5, except that a second magnet 67, having the same polarity as magnet 60, is positioned further toward the rear in the shaft of arrow 23, just to the rear of ring magnet 30, when the bow is fully drawn just before release. As in FIG. 5, magnet 60 and ring magnet 30 repel each other. Because of the shape of ring magnet 30, the repulsive magnetic forces from the front of ring magnet 30 on magnet 60 in arrow 23 are radially inward as well as forward. Since the rear end of arrow 23 is held firmly against the drawn bowstring, the forward magnetic force is counterbalanced. The radially inward magnetic forces help to center arrow 23 into a good, stable position for release. Gravity is partially counterbalanced by the upward repelling force on magnet 60 from the lower part of ring magnet 30. Simultaneously, the forward-facing south pole of magnet 67 is repelled backward and radially inward by the south pole of rear face 80 of ring magnet 30. The backward force is counterbalanced by the bowstring against the rear end of arrow 23. The inward forces on magnet 67 help to center arrow 23 in ring magnet 30. The upward repelling force on magnet 67 from the lower portion of ring magnet 30 works in conjunction with the upward repelling force on magnet 60 to counterbalance gravity.

Figure 9:
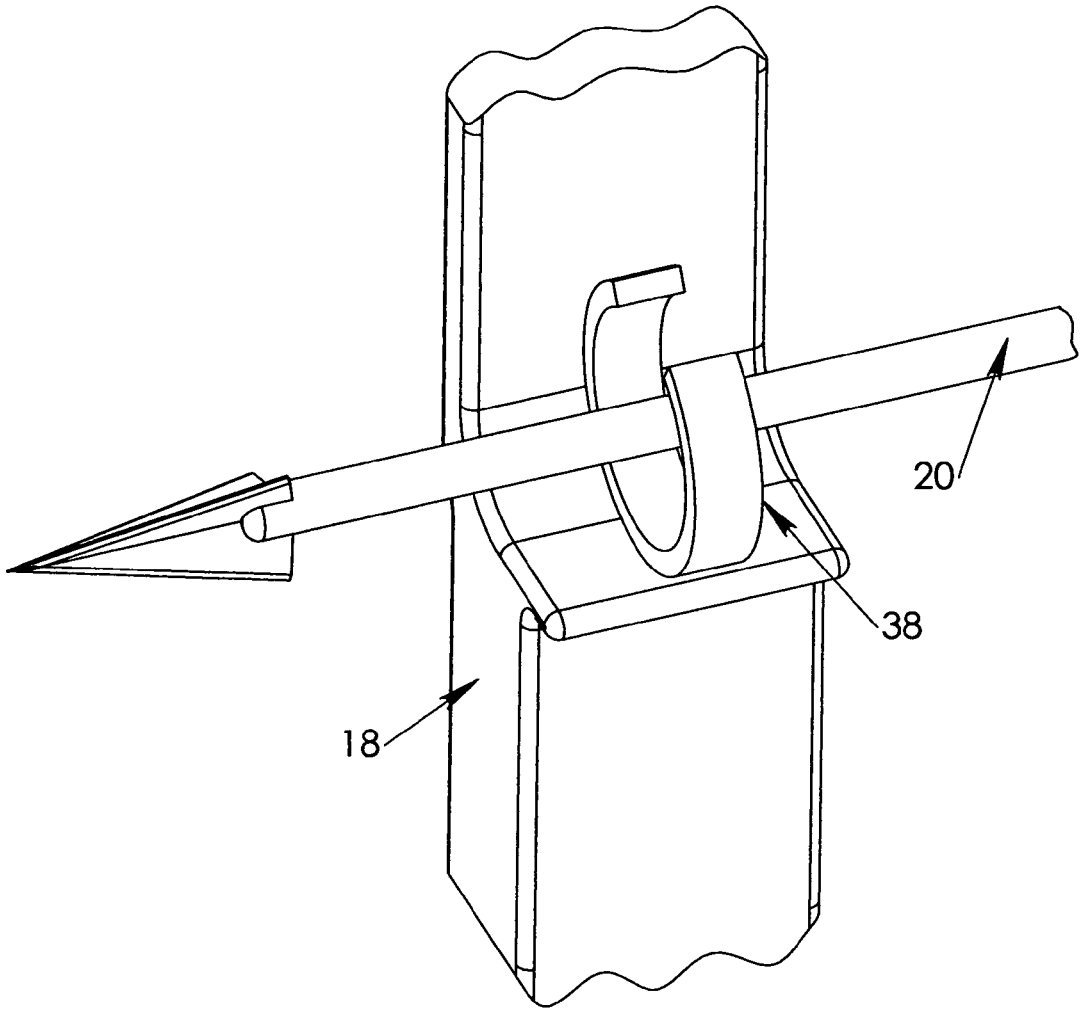
FIG. 9 is a perspective view of a magnetic arrow in release position at a bow levitated by a magnetic field from a C-shaped magnet.

In an alternative arrangement, shown in FIG. 9, a segment of the top portion of ring magnet 30 may be removed. This leaves a C-shaped permanent magnet 38 with the open side facing upward. The deletion of this segment removes some downward magnetic force on magnetic arrow 20, allowing arrow 20 to levitate a bit higher. The upward-facing open side of the C-shaped magnet is convenient for placing an arrow quickly into release position.

Figure 10:
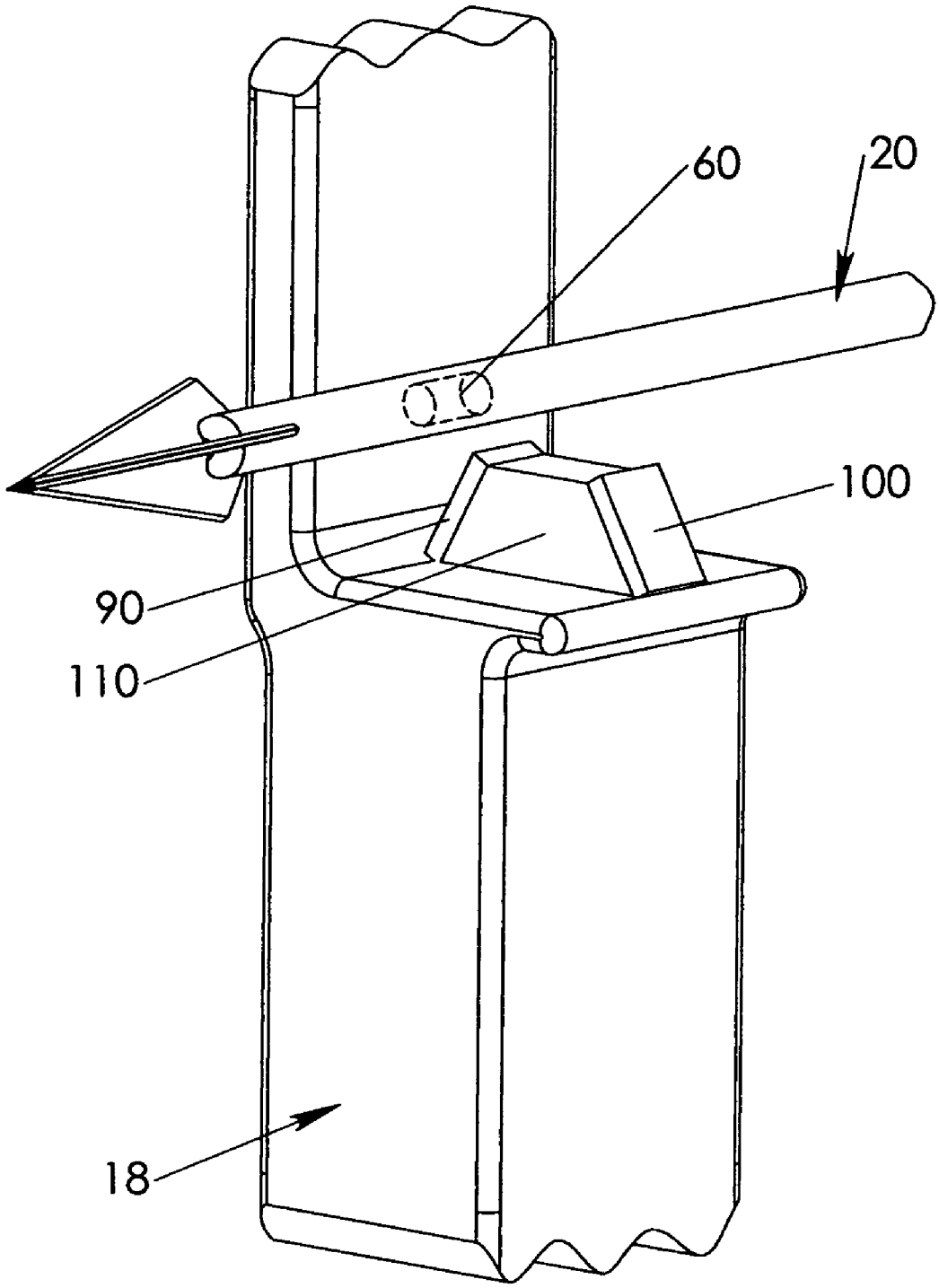
FIG. 10 is a perspective view of an axially magnetized magnetic arrow in release position at a bow levitated by a magnetic field from two bar magnets.

It is evident that circular arrangements of small bar magnets can replace ring magnets 30 or 35. But a simpler minimal arrangement of bar magnets can also levitate magnetic arrows. In FIG. 10, two small bar magnets, 90 and 100, are firmly affixed to bow 18 with their north poles facing upward and inward toward the shaft of arrow 20. The space between bar magnets 90 and 100 is filled with a non-magnetic material 110, such as wood, plastic, fiberglass, etc. As an archer draws arrow 20 back into the release position of FIG. 10, arrow 20 slides on non-magnetic material 110. As the rearward-facing north pole of magnet 60 approaches the north poles of magnets 90 and 100, magnetic arrow 20 is repelled forward, upward, and inward by bar magnets 90 and 100. The forward force is counterbalanced by the archer pressing the rear of arrow 20 against the bowstring. The upward force is counterbalanced by gravity. The inward forces center arrow 20 between bar magnets 90 and 100. Thus arrow 20 levitates above non-magnetic material 110. The strength of the magnetic field is sufficient for the clearance between arrow 20 and non-magnetic material 110 to be large enough so that no part of arrow 20 will make contact with non-magnetic material 110 or any other part when it is released.

Figure 11:
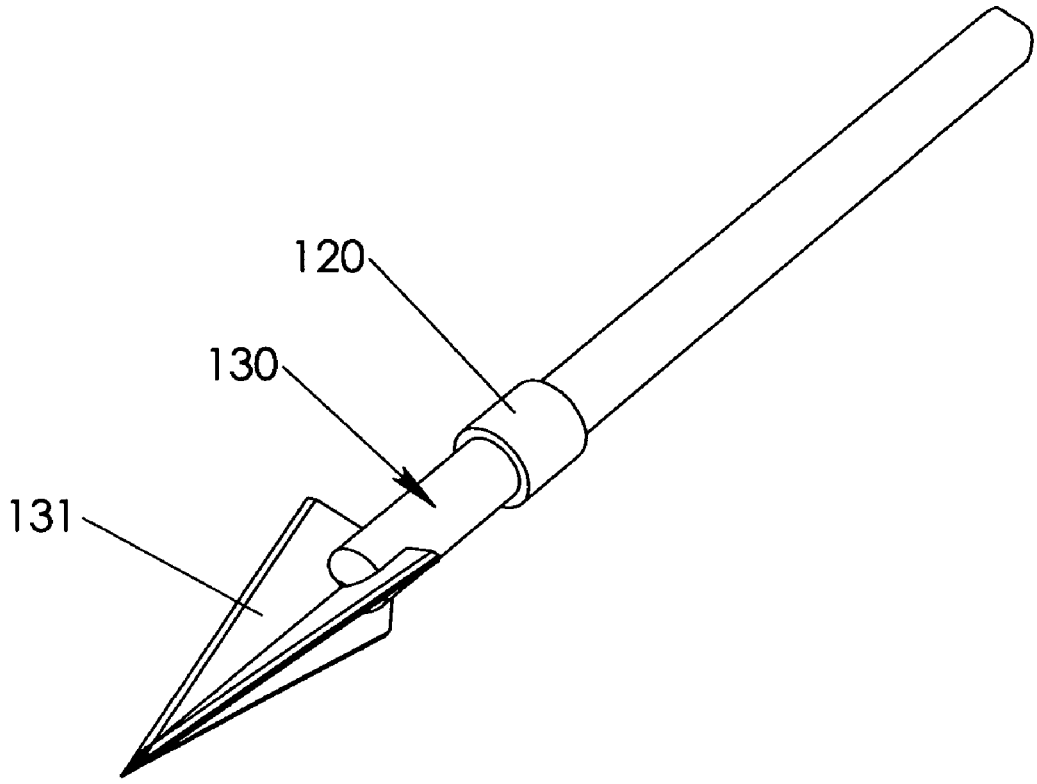
FIG. 11 shows a magnetic arrow formed by affixing a permanent magnet around the shaft of a non-magnetic arrow.

Typical non-magnetic arrows may be changed into magnetic arrows for use in the present invention. FIG. 11 shows a typical non-magnetic arrow 130 to which a tubular cylindrical magnet 120 has been added. Magnet 120 may be formed from sections of permanent magnetic material glued together around arrow 130. Magnet 120 may also be formed by sections of permanent magnetic material surrounded by a plastic sleeve that snaps into place around the shaft of arrow 130. In this example, the magnetic field of magnet 120 is oriented in the axial direction with a north pole facing rearward and a south pole facing forward, which is the same orientation as magnet 60 in FIG. 5.

Figure 12:
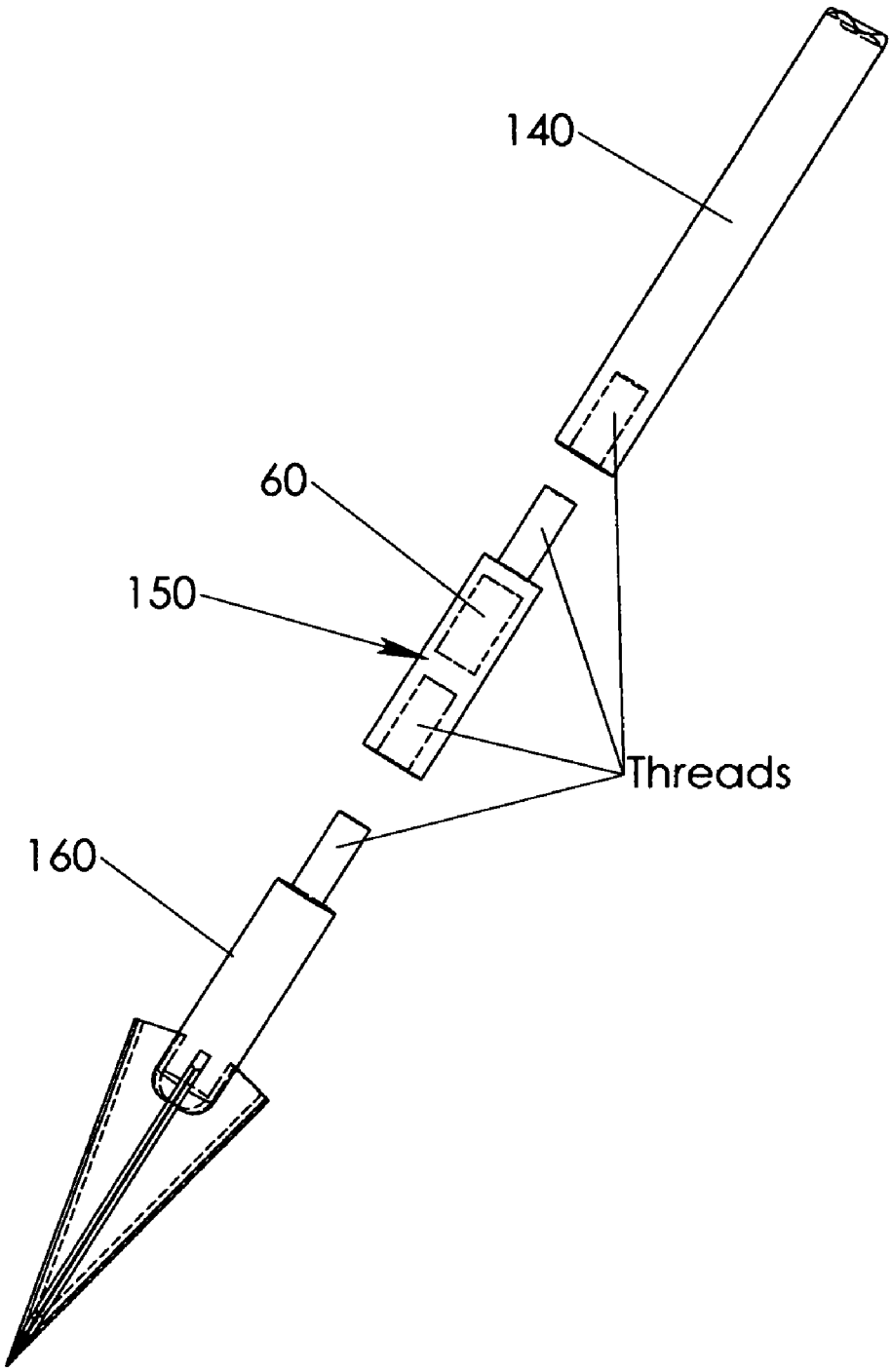
FIG. 12 shows a magnetic arrow formed by inserting a threaded insert containing a permanent magnet in between the arrowhead and the shaft of a non-magnetic arrow.

Another means of changing a non-magnetic arrow to a magnetic arrow is shown in FIG. 12. Typical non-magnetic arrows are often composed of multiple parts comprising a shaft 140 with a threaded hole at the front end and an arrowhead 160 with a screw protruding from its rear, which fits into the threaded hole. An insert 150 containing a small permanent magnet 60 may be inserted between shaft 140 and arrowhead 160. Arrowhead 160 screws into a matching threaded hole in the front of insert 150. A screw at the rear of insert 150 fits into the threaded hole of shaft 140. The resulting assembly may be used like magnetic arrow 20. As another alternative, arrowhead 160 and insert 150 may be permanently joined together to form a magnetic arrowhead component. Such a magnetic arrowhead may be screwed into a typical shaft instead of a typical non-magnetic arrowhead in order to form a magnetic arrow.

Many arrowheads contain steel or other materials that are ferromagnetic. By exposure to a strong magnetic field, ferromagnetic material may be temporarily magnetized. Assume that typical non-magnetic arrow 130 of FIG. 11 has an arrowhead 131 made of ferromagnetic material. Instead of converting arrow 130 to a magnetic arrow by using magnet 120, arrowhead 131 may be magnetized shortly before use. Thus a magnetized ferromagnetic arrowhead may act in place of a permanent magnet such as magnet 120.

On the other hand, a ferromagnetic arrowhead may be considered a nuisance when it is not magnetized deliberately to enable levitation. Such an arrowhead may be attracted to ring magnets 30 or 35 or bar magnets 90 and 100. Such attraction might annoy an archer during ordinary handling, or perturb the flight of a magnetic arrow immediately after release. This problem may be solved by providing an arrowhead that contains no ferromagnetic material.

Figure 13:
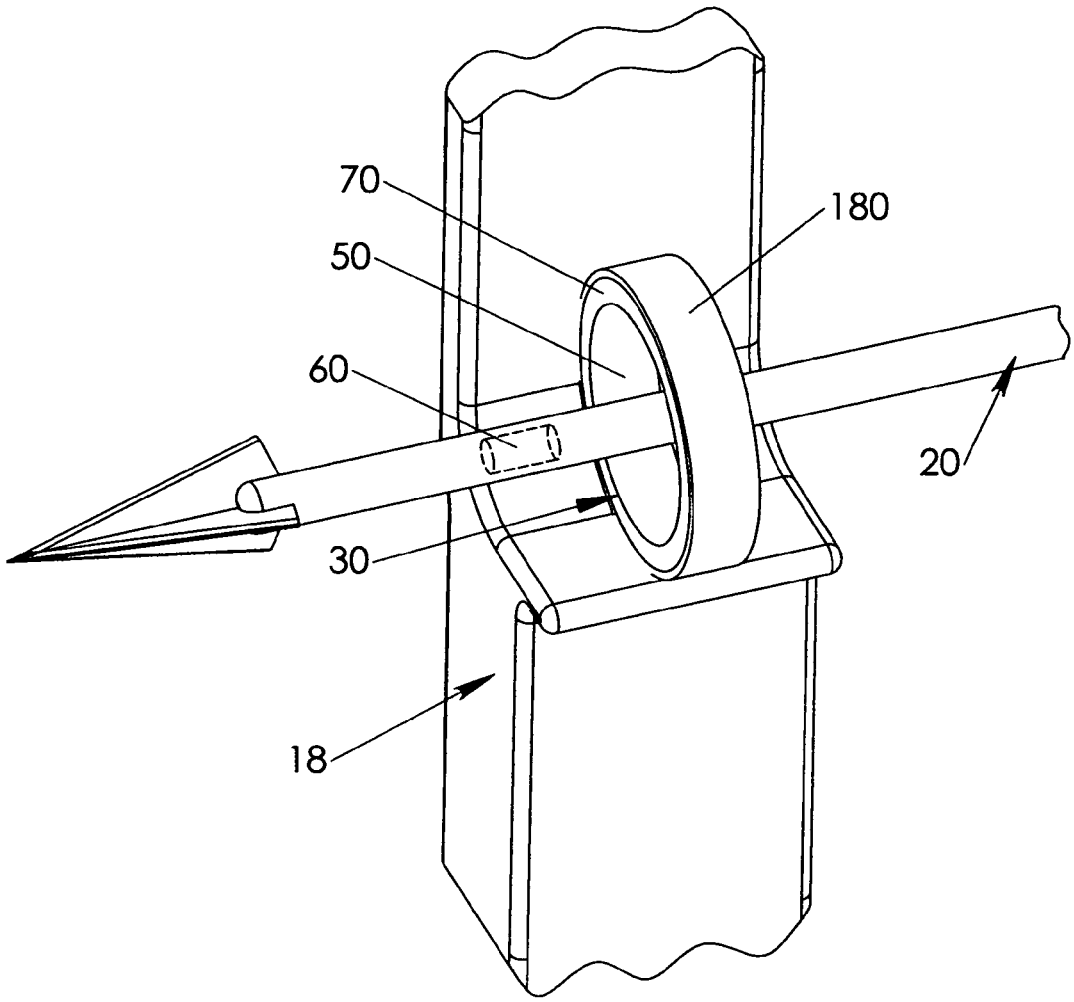
FIG. 13 is a perspective view of a magnetic arrow supported in release position at a bow by a magnetic field from a ring magnet, in which the ring magnet is covered with magnetic shielding on its outer surface.

Ring magnet 30 in FIG. 5 has a magnetic field that extends not only inward toward magnetic arrow 20 but also outward from its outer cylindrical surface 40. This outward-extending field may be inconvenient to an archer because ring magnet 30 will attract, and possibly stick to, ferromagnetic objects such as automobiles, steel watches, belt buckles, etc. This problem may be mitigated by covering outer cylindrical surface 40 with magnetic shielding material 180 to shape the field. (For example, Mumetal® alloy, described in "Material Information: Mumetal® Magnetic Shielding Alloy", Goodfellow Corporation, [retrieved on Jun. 21, 2003], retrieved from <URL: http://www.goodfellow.com/csp/active/static/A/NI03.HTML>.) Such an arrangement is shown in FIG. 13.

Figure 14:
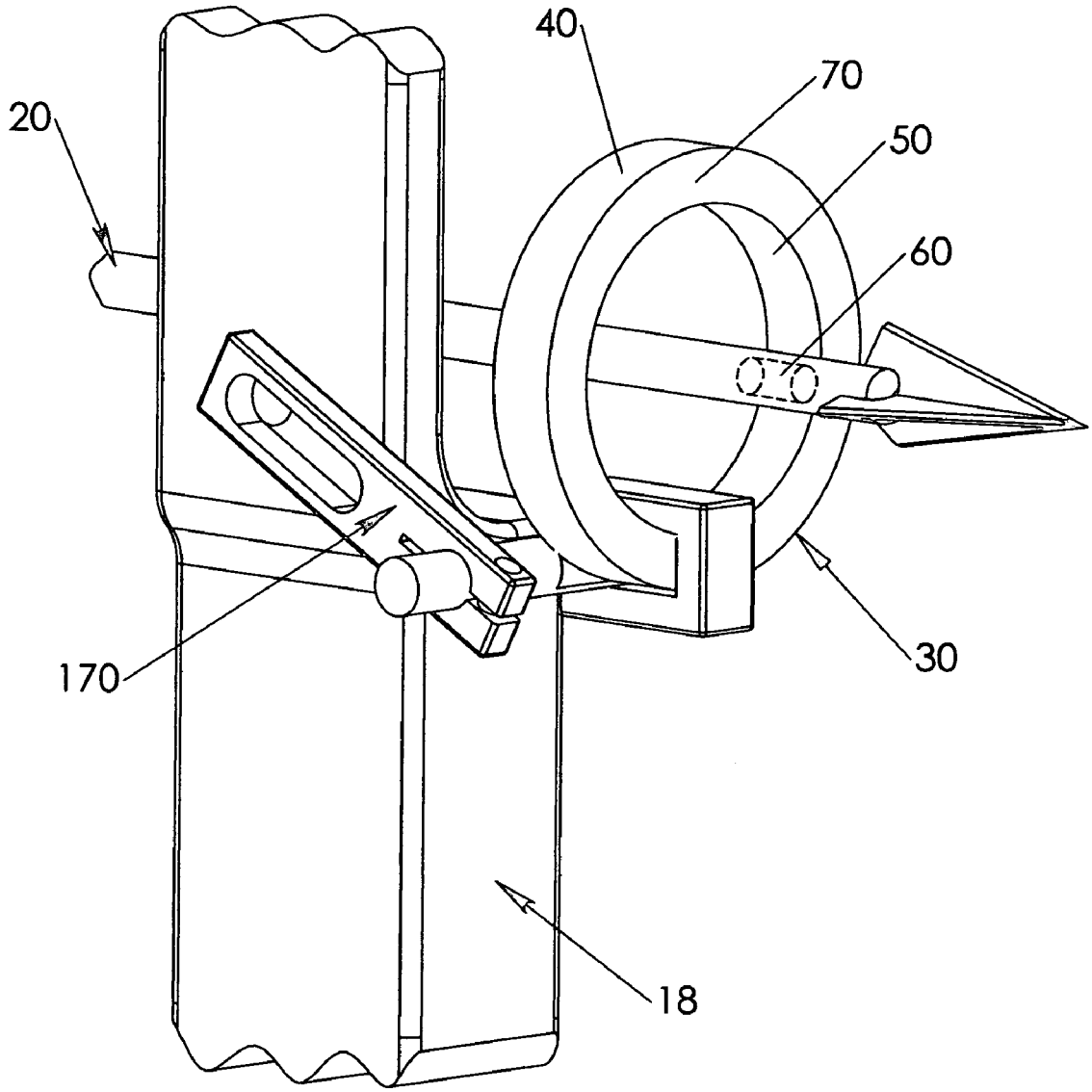
FIG. 14 is a perspective view of a magnetic arrow supported in release position at a typical bow by a magnetic support assembly attached to the bow with a bracket assembly.

Many bows are built with threaded holes that allow an archer to attach many different arrow rests. A magnetic assembly for levitating the front of a magnetic arrow may be designed to accommodate such mounting holes and thus be attachable to many bows that were not originally designed for magnetic levitation. FIG. 14 shows the magnetic levitation assembly of FIG. 5 with the addition of a bracket 170 to make the assembly adaptable to a great variety of bows.

Figure 15:
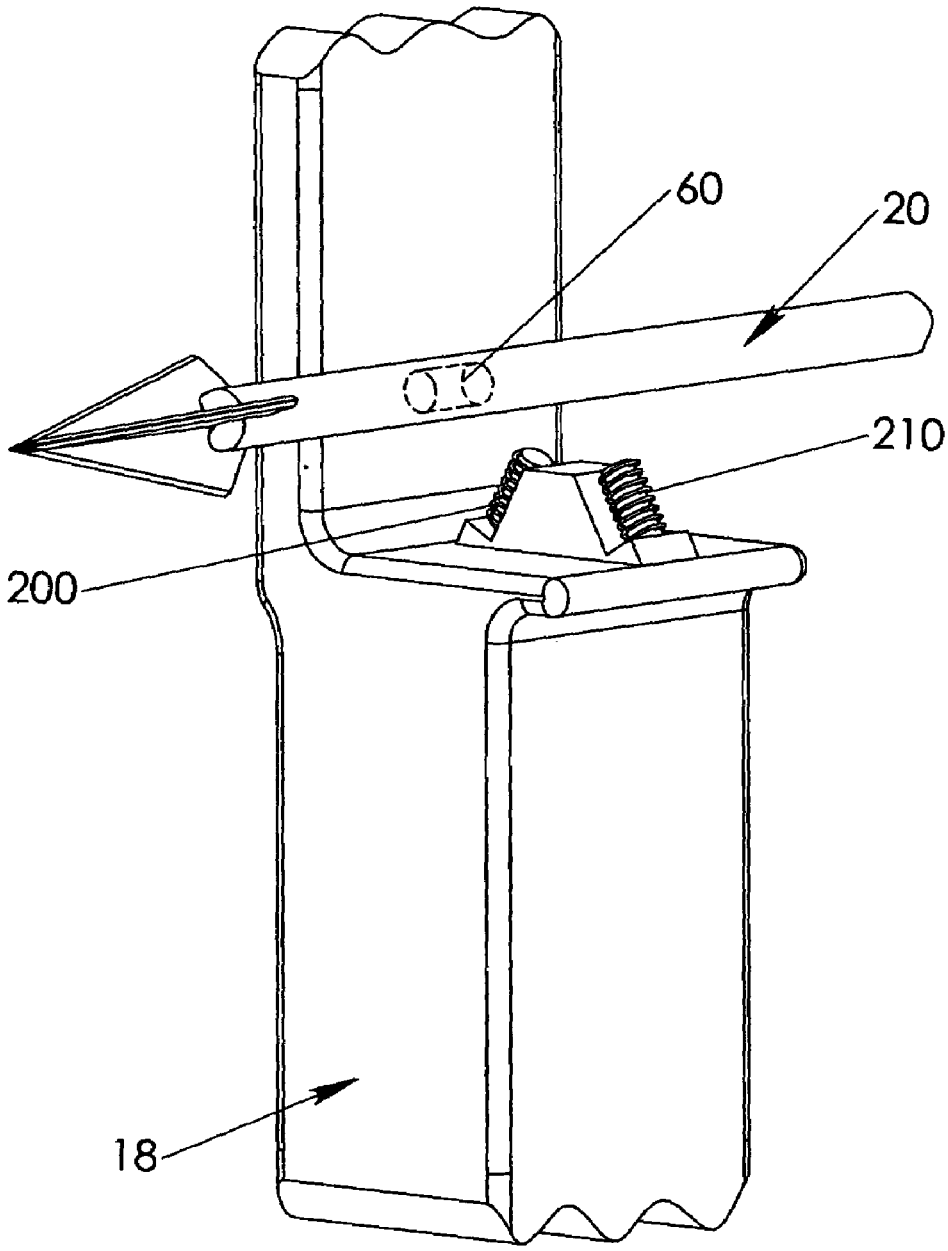
FIG. 15 is a perspective view of a magnetic arrow in release position at a bow levitated by a magnetic field from two electromagnets.

The present invention may also be implemented by substituting electromagnets for permanent magnets. FIG. 15 shows the substitution of electromagnets 200 and 210 for bar magnets 90 and 100 (shown in FIG. 10).

Conclusion and Variations

By levitating the front of an arrow in a magnetic field just before release, the present invention eliminates friction and contact between an arrow and a bow, or any apparatus attached to the bow. This eliminates known causes of deviation from an arrow's desired flight path.

Besides the preferred embodiments described above, the present invention has a number of additional variations. Some examples are described below.

The example of FIG. 1 has radially oriented magnetic fields generated from both ring magnet 35 and magnetic arrow 22. The example of FIG. 5 has axially oriented magnetic fields generated from both ring magnet 30 and magnetic arrow 20. It is easy to see that axially magnetized arrow 20 will also levitate in radially magnetized ring magnet 35. Furthermore, any angle of orientation of the magnetic field in a ring magnet, which is at an angle between the forward-facing north pole of ring magnet 30 and the radially inward-facing north pole of ring magnet 35, will repel and center magnet 60, which is set forward in arrow 20, and maintain levitation.

It is easy to see that reversing all of the magnetic poles in any of the arrangements described above will maintain the repulsive forces in the same strength and orientation, thus levitating a magnetic arrow in the manner described above. This is because magnetic repulsion occurs between any like poles, whether they are both north or both south.

The embodiments described above include a bow with limbs aligned generally in a vertical plane. It will be obvious to anyone skilled in the relevant arts that the present invention is also applicable to crossbows, which have limbs aligned generally in a horizontal plane.

It is possible for an arrow to be levitated by the repulsive diamagnetic force between a magnet and a superconductor. The superconductor may be used in a magnetic support assembly with a magnetic arrow, or the superconductor may be used in an arrow with magnets used in the support assembly.

In light of these numerous variations of the preferred embodiments, the scope of the present invention should be determined by the following claims.

We claim:

1. A method for supporting an arrow on a bow comprising:

providing a bow, providing a magnetic arrow, and arranging a magnetic field to support said magnetic arrow in a stable position with relation to said bow, whereby said magnetic arrow may be released with little or no unintended effect on its flight path.

2. The method of claim 1 wherein providing a magnetic arrow comprises placing one or more substantially axially oriented magnetic portions into an arrow at the time of its manufacture.

3. The method of claim 1 wherein providing a magnetic arrow comprises placing one or more substantially radially oriented magnetic portions into an arrow at the time of its manufacture.

4. The method of claim 1 wherein providing a magnetic arrow comprises placing one or more permanent magnets into an arrow at the time of its manufacture.

5. The method of claim 1 wherein providing a magnetic arrow comprises affixing one or more permanent magnets to a non-magnetic arrow.

6. The method of claim 1 wherein providing a magnetic arrow comprises magnetizing one or more ferromagnetic portions of a non-magnetic arrow or an arrowhead attached to said non-magnetic arrow.

7. The method of claim 1 wherein providing a magnetic arrow comprises affixing a component containing one or more permanent magnets at the front end of a shaft of a non-magnetic arrow.

8. The method of claim 1 wherein arranging a magnetic field comprises arranging a substantially axially oriented magnetic field.

9. The method of claim 1 wherein arranging a magnetic field comprises arranging a substantially radially oriented magnetic field.

10. The method of claim 1 wherein arranging a magnetic field comprises arranging an electromagnetic field.

11. The method of claim 1 wherein arranging a magnetic field comprises placing magnetic magnetic shielding material to shape the field.

12. The method of claim 1 wherein arranging a magnetic field comprises arranging permanently magnetic material.

13. The method of claim 12 wherein arranging permanently magnetic material comprises arranging bar magnets.

14. The method of claim 12 wherein arranging permanently magnetic material comprises arranging a ring magnet.

15. The method of claim 12 wherein arranging permanently magnetic material comprises arranging a C-shaped magnet.

16. A magnetic support assembly comprising a magnetic field arranged to support a magnetic arrow in a stable position with relation to a bow without contact between said assembly and said magnetic arrow, whereby said magnetic arrow may be released with little or no unintended effect on its flight path.

17. The magnetic support assembly of claim 16 wherein said magnetic support assembly further includes means for attaching the assembly to a wide variety of bows.

18. The magnetic support assembly of claim 16 wherein said magnetic field is generated by electromagnets.

19. The magnetic support assembly of claim 16 wherein said magnetic field is generated by one or more substantially axially oriented magnets.

20. The magnetic support assembly of claim 16 wherein said magnetic field is generated by one or more substantially radially oriented magnets.

21. The magnetic support assembly of claim 16 wherein said magnetic field is generated by permanently magnetic material.

22. The magnetic support assembly of claim 21 wherein said permanently magnetic material comprises bar magnets.

23. The magnetic support assembly of claim 21 wherein said permanently magnetic material comprises a ring magnet.

24. The magnetic support assembly of claim 21 wherein said permanently magnetic material comprises a C-shaped magnet.

25. The magnetic support assembly of claim 21 wherein said magnetic support assembly further includes magnetic shielding material.

26. A magnetic arrow comprising:

a shaft a magnetized portion with a fixed position in relation to said shaft, which produces a magnetic field having a precise combination of position, geometry, and strength to enable a magnetic support assembly to support said magnetic arrow in a stable position with relation to a bow, whereby said magnetic arrow may be released with little or no unintended effect on its flight path.

27. The magnetic arrow of claim 26 wherein said magnetized portion comprises one or more substantially anally oriented magnets.

28. The magnetic arrow of claim 26 wherein said magnetized portion comprises one or more substantially radially oriented magnets.

29. The magnetic arrow of claim 26 wherein said magnetized portion comprises one or more permanent magnets included in said magnetic arrow at the time of its manufacture.

30. The magnetic arrow of claim 26 wherein said magnetized portion comprises one or more permanent magnets affixed to said shaft.

31. The magnetic arrow of claim 26 wherein said magnetized portion comprises one or more permanent magnets included in a component affixed to the front end of said shaft.

32. The magnetic arrow of claim 26 further comprising an arrowhead that is composed of material that is not ferromagnetic.

33. A magnetic arrowhead comprising a magnetized portion which produces a magnetic field that is strong enough to enable a magnetic support assembly to support an arrow using said magnetic arrowhead in a stable position with relation to a bow.

34. The magnetic arrowhead of claim 33 wherein said magnetized portion comprises one or more substantially axially oriented magnets.

35. The magnetic arrowhead of claim 33 wherein said magnetized portion comprises one or more substantially radially oriented magnets.

36. The magnetic arrowhead of claim 33 wherein said magnetized portion comprises one or more permanent magnets included in said magnetic arrowhead at the time of its manufacture.

* * * * *

UNITED STATES PATENT AND TRADEMARK OFFICE

CERTIFICATE OF CORRECTION

PATENT NO. : 6,920,870 B2
DATED : July 26, 2005
INVENTOR(S) : Minica et al.

It is certified that error appears in the above-identified patent and that said Letters Patent is hereby corrected as shown below:

Column 8,
Lines 30-32, claim 27 should be
27. The magnetic arrow of claim 26 wherein said magnetized portion comprises one or more substantially axially oriented magnets.

Signed and Sealed this

Fourth Day of October, 2005

JON W. DUDAS
*Director of the United States Patent and Trademark Office*